United States Patent [19]

Leaver et al.

[11] 4,413,848

[45] Nov. 8, 1983

[54] LATCHING MECHANISM FOR PANELS

[75] Inventors: John Y. Leaver, Elkhart, Ind.; Harold D. Huggins, Quincy, Ill.

[73] Assignee: The Knapheide Mfg. Co., Quincy, Ill.

[21] Appl. No.: 223,626

[22] Filed: Jan. 9, 1981

[51] Int. Cl.[3] ..... E05C 5/02

[52] U.S. Cl. ..... 292/59

[58] Field of Search ..... 292/59, 60, 62, 241, 292/57

[56] References Cited

U.S. PATENT DOCUMENTS

| | | | |
|---|---|---|---|
| 368,595 | 8/1887 | King . | |
| 432,639 | 7/1890 | Newton | 292/62 |
| 534,987 | 3/1895 | Alsdorf | 292/62 |
| 860,769 | 7/1907 | Tait . | |
| 925,650 | 6/1909 | Raforth | 292/62 |
| 1,326,937 | 1/1920 | Kasper | 292/62 |
| 1,370,007 | 3/1921 | Davis, Jr. . | |
| 1,907,432 | 5/1933 | Mears et al. . | |
| 1,942,219 | 1/1934 | Segal | 292/251 |
| 1,950,600 | 3/1934 | De Orlow | 292/61 |
| 1,950,600 | 3/1934 | Orlow | 292/62 |
| 2,121,784 | 6/1938 | Busby | 151/32 |
| 2,749,851 | 6/1956 | Dorey | 292/57 X |
| 3,298,728 | 1/1967 | Dye | 292/62 |

OTHER PUBLICATIONS

Knapheide Drawings (Six Sheets, A–F) for Steel Stake Body and Stake Rack Lock.

*Primary Examiner*—Richard E. Moore

*Attorney, Agent, or Firm*—Geoffrey R. Myers

[57] ABSTRACT

A latching device to connect two adjacent members (i.e. truck panels) is provided. The latching device is comprised of two parts, a movable latching member and a receiving member, each attached to adjacent panels. The movable latching member is comprised of a plate, a retaining bracket, a latch rod and a spring. The latch rod has a ring fixedly attached thereto and is rotatably and slidably received within the retaining bracket, which is in turn attached to the plate. The spring circumferentially surrounds a portion of the latch rod and has its ends abutting the bracket and the ring thereby biasing the rod toward its retaining position. The receiving means is connected to a second panel and has a slot therein. The latch rod has an engaging end which is received within the slot and firmly engages the slot. The engaging end has a cam surface which acts to pull the latch rod further within the receiving member, against the bias of the spring, when the latch rod is rotated in a selected direction (and vice versa if the latch rod is rotated in the opposite direction). This arrangement reduces the relative movement between the two panels and, thus, reduces the vibratory noises generated by the panels.

1 Claim, 12 Drawing Figures

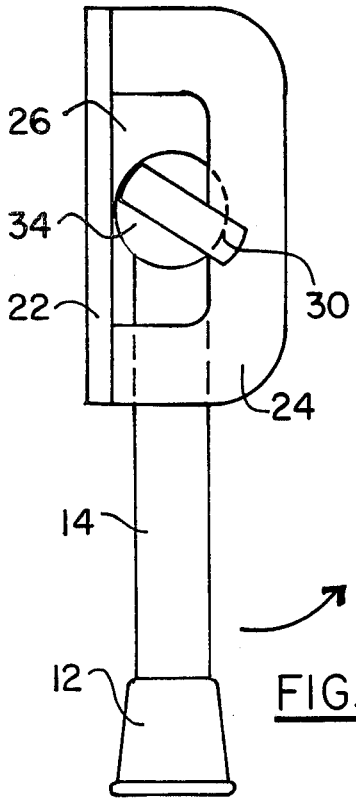
FIG. 3
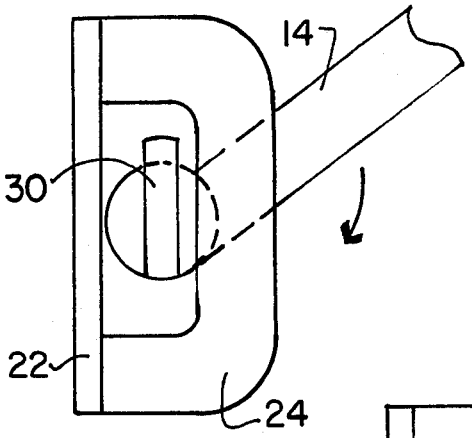
FIG. 5
FIG. 6
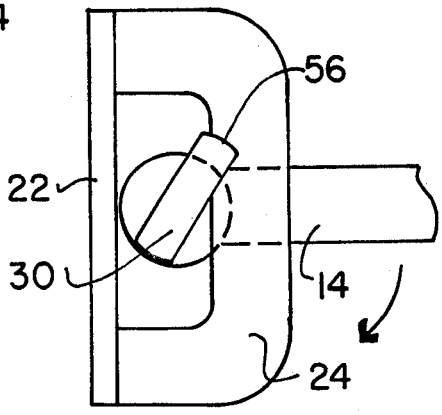
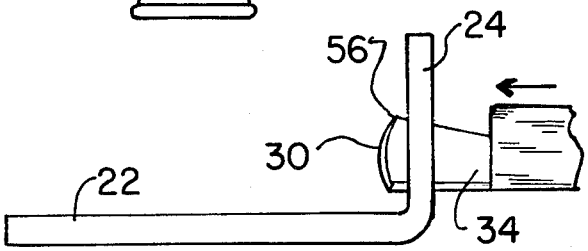
FIG. 7
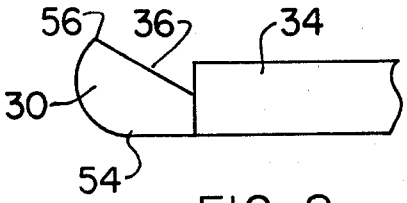
FIG. 8
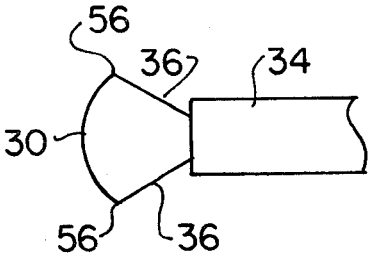
FIG. 9
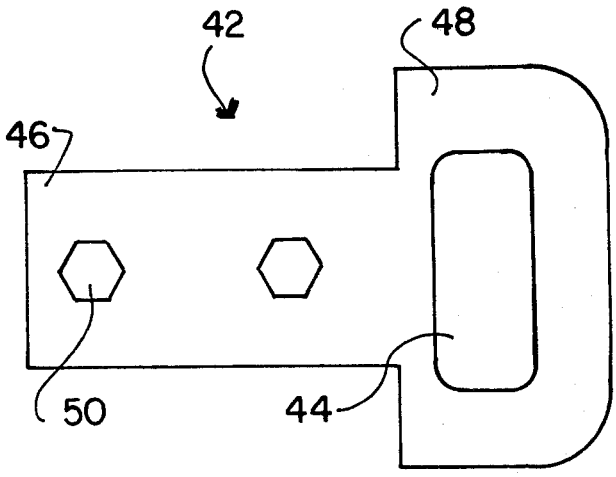
FIG. 10

FIG. 11
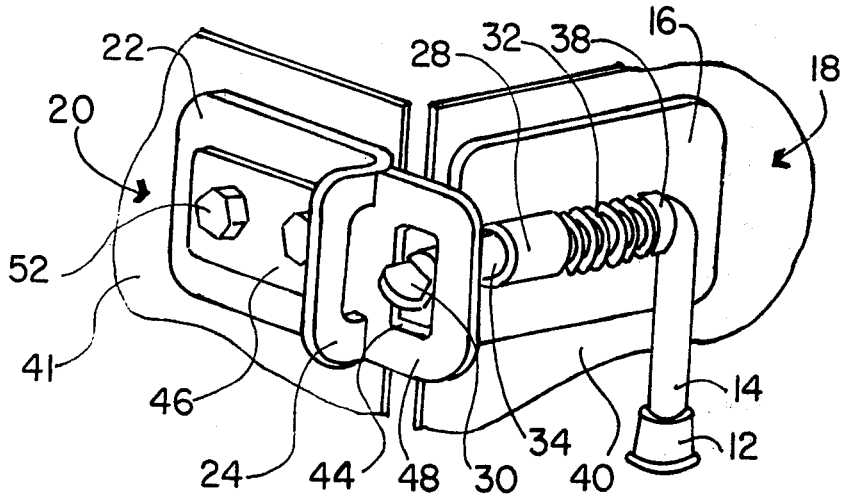
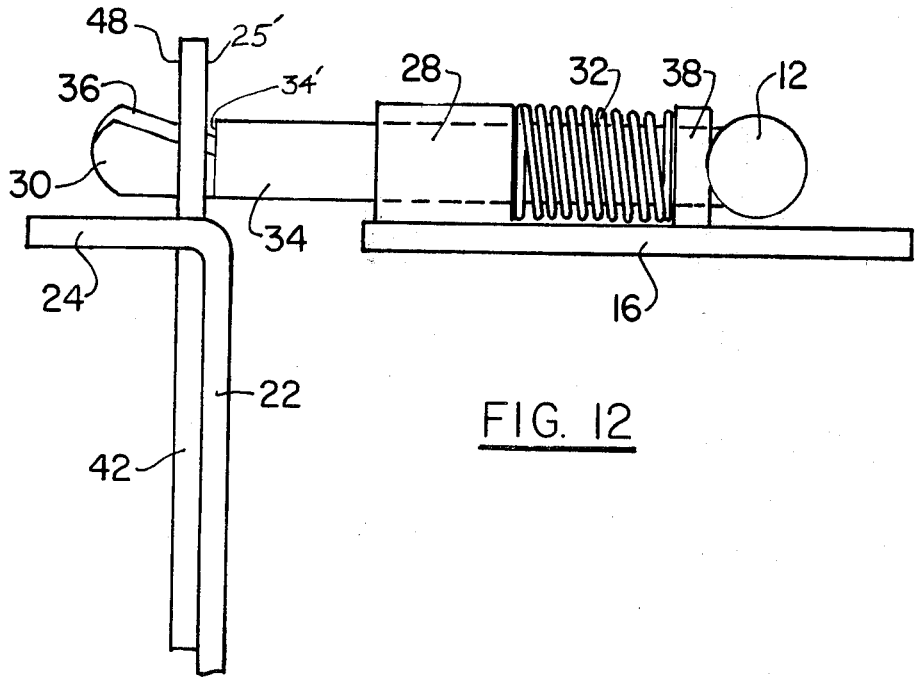
FIG. 12

LATCHING MECHANISM FOR PANELS

This invention relates to latches for fastening two members together. In particular, this invention relates to latches having particular utility in the truck body industry for tightly securing various body parts together thereby preventing noise and vibration during operation and providing improved stability.

BACKGROUND OF THE INVENTION

There are many situations in which it is desired to latch two members together to prevent anything but minimal relative movement between the two members while at the same time allowing the two members to be easily parted when desired. One such situation, discussed in detail below as an illustration of all of these situations, is a panel truck.

Trucks having cargo boxes comprised of removable side walls (i.e. panels) are well known in the art. The truck platform usually has spaced post holes located along its periphery. The truck panels have mating posts extending downward from the panels for insertion into these post holes. Because of the size of the panels, and other factors, the tolerances allowed between the posts and the post holes is relatively large and the fit is not very snug. Therefore, if the panels are only secured by placing them in the post holes and are not fastened to each other, the panels will sway back and forth, will vibrate, be the source of noise, and will not be very stable.

To prevent this swaying and to provide lateral support for the panels, the panels are usually fastened together after they have been installed in the proper post holes. These fasteners may be comprised of cross braces that run the length and width of the truck to which the panels are attached or latches that are attached to two adjoining panels to latch them together.

No matter which type of prior art supporting system is used, the relatively large tolerances in either system allows the panels to move relative to each other and their supporting systems. This movement, or vibratory effect, as the truck is driven down the highway generates undesirable noise. This noise is not only distracting and uncomfortable for the driver, thus, making the driver less alert, but also is loud enough to cover up audio warning signals important to traffic safety, such as ambulance sirens, children playing, etc. In addition, at times, the large tolerances hereto allowed may result in undue swaying of the cargo or the body itself.

Attempts at increasing the tightness of hold or retention between the panels has at times resulted in either a too complicated or expensive mechanism or a system which is not easily disengaged when it is desired to separate the panels. A need in the art, therefore, exists for a latching mechanism which is both effective, easy to disengage and yet reasonably uncomplicated and inexpensive.

It is a purpose of this invention to fulfill this need by providing an easily manufactured, uncomplicated latching device which securely and firmly connects adjacent members, allowing minimal vibration and movement between the members while at the same time providing an easy and reliable means for disengaging the members, thereby allowing them to be readily separated.

SUMMARY OF THE INVENTION

Generally speaking, this invention fulfills its purpose by providing a latching device for attaching a first and a second member together comprising: a rotatable latch rod slidably attached to said first member, said latch rod having an engaging end; and receiving means attached to said second member for engaging said engaging end, the improvement comprising said latch rod being spring biased away from said receiving means, said engaging end having an edge defining a cam surface such that when said latch rod is engaging said receiving means and when said latch rod is rotated, said latch rod moves in a direction along its longitudinal axis.

In certain embodiments of this invention, the latch rod is attached to the first member by a plate and a hollow cylinder. The latch rod is rotatably and slidably received within the hollow cylinder. The hollow cylinder is attached to the plate which is, in turn, attached to the first member. The latch rod has a ring attached thereto and a spring circumferentially surrounding a portion thereof. The ends of the spring abut the hollow cylinder and the ring. The spring is placed in compression when the latch rod and ring are pushed towards the hollow cylinder.

In some embodiments of this invention the receiving means is comprised of a plate having a slot therein to receive the engaging end. The plate is comprised of two portions, a first portion which attaches to the second member, and a second portion which extends outward from the second member and has the slot therein.

The engaging end is easily manipulated into and out of engagement with the receiving means. When the engaged, and rotated to actuate the cam surface to its tightest position, the spring-biasing of the latch rod away from the receiving means creates a firm locking action between the receiving means and the latch rod. This locking action minimizes the relative movement between the two members and, thus, overcomes the problems in the prior art discussed above.

IN THE DRAWINGS

FIG. 3 is a front view of the embodiment of this invention illustrated in FIGS. 1 and 2.

FIG. 5 is a front view of the embodiment of this invention illustrated in FIGS. 1–4 showing the engaging end being inserted into the slot of the receiving means.

FIG. 6 is the same view as FIG. 5 after the latch rod has been rotated such that the engaging end of the latch rod is engaging the receiving means.

FIG. 7 is a bottom view showing the latch rod and the engaging member in the same position as they are shown in FIG. 6.

FIG. 8 is a side view of one embodiment of the engaging end of a latch rod that can be used in the practice of this invention.

FIG. 9 is a side view of a second embodiment of the engaging end of a latch rod that can be used in the practice of this invention.

FIG. 10 is a side view of an insert that can be employed with the embodiment of this invention illustrated in FIGS. 1–7 to change it from a latching device to latch two panels edge-to-edge to a latching device for latching two panels together to form a corner.

FIG. 11 is a perspective view illustrating the insert illustrated in FIG. 10 installed in place.

FIG. 12 is a bottom view of the assembly illustrated in FIG. 11.

DETAILED DESCRIPTION OF THE DRAWINGS

Figure 1:
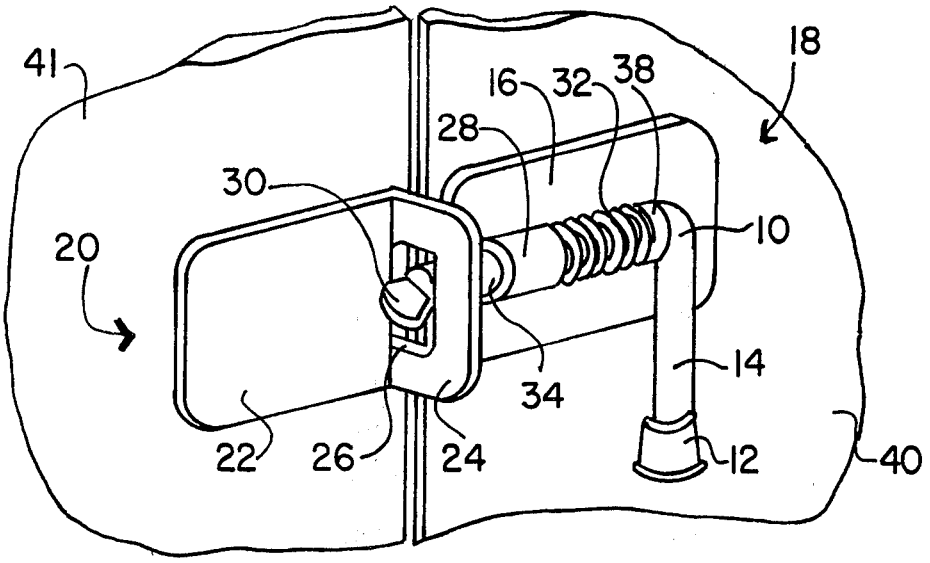
FIG. 1 is a perspective view of one embodiment of this invention that can be employed to latch two panels together edge-to-edge.
Figure 2:
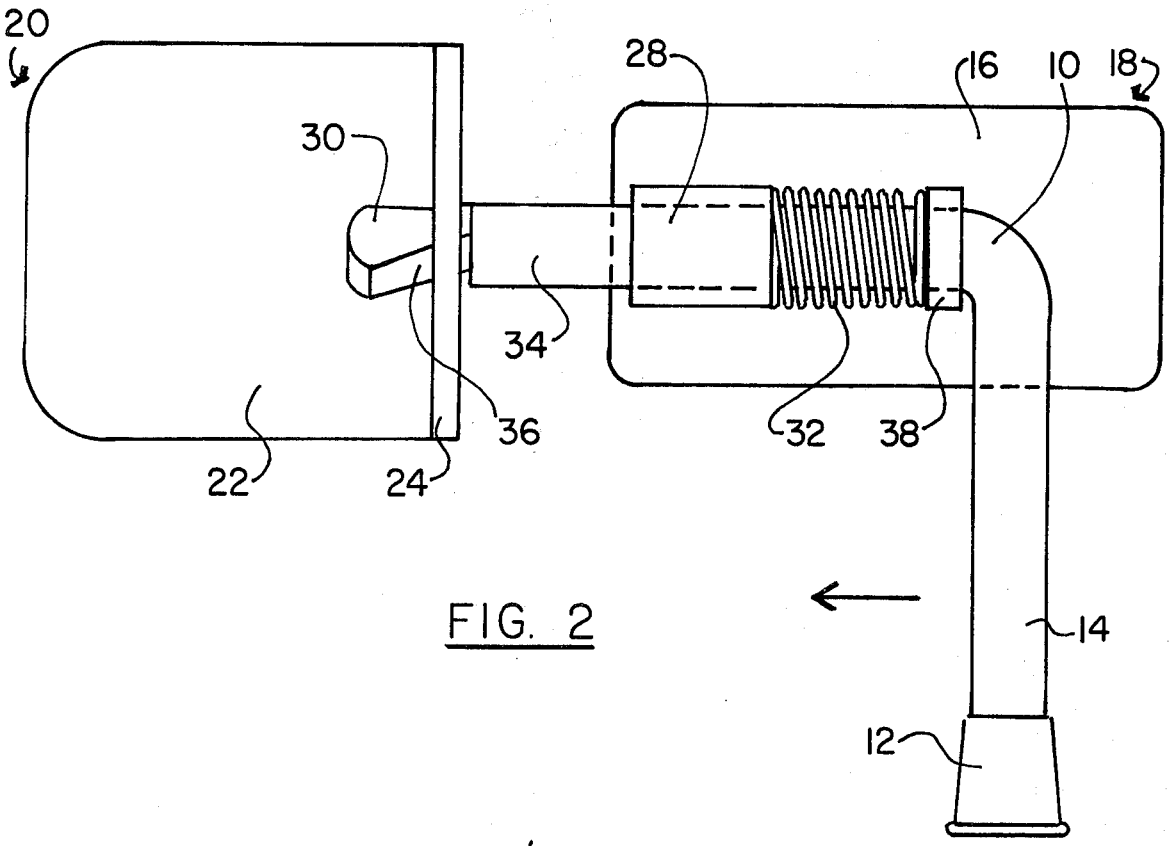
FIG. 2 is a side view of the embodiment of this invention illustrated in FIG. 1.
Figure 4:
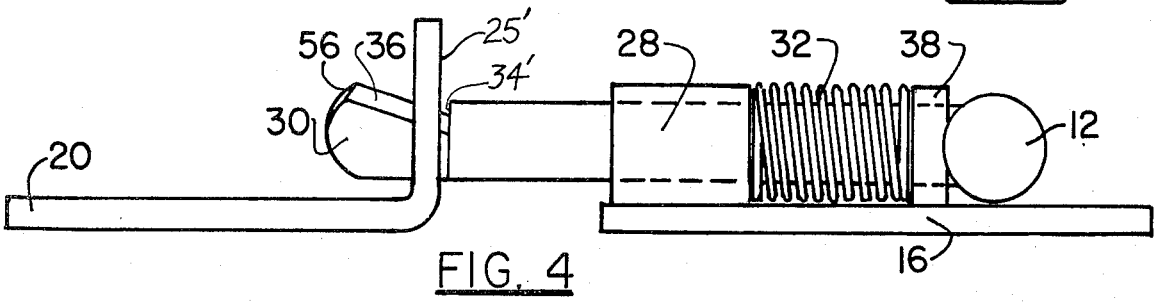
FIG. 4 is a bottom view of the embodiment of this invention illustrated in FIGS. 1–3.

Referring to the Figures, in particular FIGS. 1–3, a latching device for latching together two adjacent panels 40 and 41, arranged edge to edge, is provided. One use for such devices are in connecting two removable panels of a panel truck. The latching device is comprised of two members, engaging member 18 and receiving member 20, one member being attached to each of said panels 40 and 41, respectively.

Engaging member 18 is comprised of latch plate 16, cylinder bracket 28, latch elbow rod 10 and coil spring 32. Latch plate 16 is attached to panel 40 by screws, rivets, welding or any other well-known fastening devices (not shown). Cylinder bracket 28 is attached on edge to the outer face of latch plate 16. Latch elbow rod 10 is comprised of two legs, handle 14 and a latch rod section 34. Latch rod section 34 is slidably and rotatably received within cylinder bracket 28 and has ring 38 fixedly attached thereto. Latch rod section 34 also has engaging end 30 formed at its end which is directed at and received by receiving means 20. Spring 32 circumferentially surrounds a portion of latch rod 34 and has its ends abutting cylinder bracket 28 and ring 38. Thus, when handle 14 and ring 38 are pushed towards cylinder bracket 28, spring 32 is placed in compression and, of course, exerts a biasing force on handle 14 and ring 38 to the right (as shown in FIGS. 1 and 2). Handle 14 has rubber tip 12 located on the end thereof to minimize the wear on panel 40 as the latch is operated.

Receiving means 20 is comprised, in the embodiment of this invention illustrated in the Figures, of an L-shaped member having flanges 22 and 24. Flange 22 abuts panel 41 and is attached thereto by any conventional fastening means such as screws, rivets, welding, etc. Flange 24 has elongated slot 26 therein. Slot 26 is formed so as to be perpendicular to the axis of latch rod section 34 when engaging member 18 and receiving means 20 of this embodiment are properly in place.

FIG. 8 illustrates one embodiment of engaging end 30 which can be employed in the practice of this invention. Engaging end 30 is a flat plate-like member having tip 56, cam surface 36 on one edge and parallel edge 54 on the opposite edge. Cam surface 36 is a surface which extends from the widest part of latch lead 30 (tip 56) on an incline to the point where latch head 30 intersects the end of the circular portion of latch rod 34. The utility of cam surface 36 will be later described in detail.

FIG. 9 illustrates another embodiment of engaging end 30 which can be employed in the practice of this invention. This embodiment has two cam surfaces 36 as described above and two tips 56 located on opposite edges of end 30.

If it is desired to employ this invention to attach two panels together to form a corner, the only member that would have to be modified from the embodiment shown in FIGS. 1–7 is receiving means 20. Receiving means 20 in this respect is simply converted to a flat plate, instead of an L-shaped member, with slot 26 extending beyond the edge of panel 41. Latch head 30 would engage slot 26 the same as in the embodiment shown in FIGS. 1–3, as will be described below.

In the alternative, FIGS. 10–12 illustrate an insert which can be employed with the embodiment of this invention illustrated in FIGS. 1–7 to convert the embodiment from a means to latch two panels together edge-to-edge to a means to latch two panels together to form a corner. Insert 42 is a flat metal member comprised of tongue 46 and head 48. Tongue 46 is designed such that its width is less than the width of slot 26 so that tongue 46 can be inserted into slot 26 and placed flush against flange 22. Tongue 46 has bolt holes 50 through which bolts 52 are passed to attach tongue 46 to flange 22. Head 48 has slot 44 therein of the same size and shape as slot 26.

When tongue 46 is attached to flange 22, head 48 will extend beyond receiving means 20 parallel to flange 22. Latch head 30 can then engage slot 44 instead of slot 26 to latch panels 40 and 41 together in the shape of a corner.

The embodiments of this invention illustrated in the Figures are employed as follows. Engaging member 18 is attached to panel 40 and receiving means 20 is attached to panel 41 as described above. Panels 40 and 41 when serving, for example, as truck body panels, are placed in their respective post holes in the bed of the truck or attached to whatever other means is employed to keep panels 40 and 41 in the vertical, cargo carrying position.

Latch rod 34 is inserted into slot 26 (or slot 44) by grasping handle 14, rotating it to the position shown in FIG. 5 and pushing handle 14 towards receiving means 20 in the direction of the arrow shown in FIG. 2 such that engaging end 30 is received in slot 26. This action will be against the bias of spring 32, compressing spring 32 between cylinder bracket 28 and ring 38. Then handle 14 is rotated, while still exerting a force in the direction of the arrow shown in FIG. 2, in the direction shown by the arrow in FIG. 6. When handle 14 is rotated to the position illustrated in FIGS. 6 and 7, the pressure in the direction of the arrow shown in FIG. 2 can be released. Tip 56 will then engage flange 24 and the connection of engaging member 18 and receiving means 20 will have been made.

Once tip 56 and cam surface 36 are abutting edge of slot 26, handle 14 can be further rotated in the direction of the arrow shown in FIG. 6 to tighten the connection between engaging member 18 and receiving means 20. As handle 14 is so rotated, cam surface 36 will slide along the edge of slot 26 from the widest part of engaging end 30 to the narrowest part of engaging end 30. As cam surface 36 and engaging end 30 move in this direction, latch rod 34 will be pulled in the direction of the arrow shown in FIG. 7, putting spring 32 further into compression. This will assure that panels 40 and 41 are firmly locked together and held relatively motionless with respect to each other so that they do not rattle with respect to each other. Spring 32 will act as a shock absorber greatly limiting the motion of panels 40 and 41 with respect to each other. Handle 14 can be rotated all the way down to the position shown in FIGS. 1–3 which is the preferred locking position. In this position surface 25 of flange 22 (or 25' of head 48) is still spaced from and does not abut end surface 34' of rod section 34.

This embodiment of the invention can be unlatched simply by rotating handle 14 in the direction of the arrow shown in FIG. 3 until engaging end 30 reaches the position shown in FIG. 5.

If the double cam surface and double tip latch head 30 is employed as shown in FIG. 9 with, for example, head 48, then one cam surface will be wedged against either side of slot 44 as handle 14 and latch rod section 34 are rotated. As latch rod section 34 and handle 14 are so rotated, each cam surface 36 will act to pull latch elbow rod 10 further through slot 44 in the direction of the arrow shown in FIG. 7, thereby providing the desired locking action between the panels.

Once given the above disclosure other modifications, embodiments and improvements will become apparent to the artisan skilled in this art. These modifications, embodiments and improvements are, therefore, considered to be within the scope of this invention as defined by the following claims:

I claim:

1. In a latching device for attaching a first and a second member together comprising a rotatable latch rod slidably attached to said first member, said latch rod having an engaging end; and receiving means for engaging said engaging end attached to said second member, the improvement comprising:

said latch rod being spring biased away from said receiving means, said engaging end having an edge defining a cam surface such that when said latch rod is engaging said receiving means and when said latch rod is rotated, said latch rod moves in a direction along its longitudinal axis;

said device further comprising a plate attached to said first member and a hollow cylinder attached to said plate, said latch rod being received within said hollow cylinder and wherein said latch rod is L-shaped having a first and a second leg, said first leg passing through said hollow cylinder, and said second leg comprising a handle;

said device further comprising a ring fixedly attached to said first leg and a spring circumferentially surrounding a portion of said first leg and being located between said hollow cylinder and said ring, and wherein said receiving means has a slot therein which receives said engaging end and is an L-shaped plate having a first and a second flange, said first flange being attached to said second member, and said slot being located in said second flange;

said device further comprising an insert for attaching to said receiving means, said insert comprising a flat member having a tongue and a head, said tongue having a width less than the width of said slot such that said tongue fits within said slot, and is attached to said first flange, said head having a second slot to receive said engaging end.

* * * * *